US008676095B2

(12) United States Patent
Itabashi

(10) Patent No.: US 8,676,095 B2
(45) Date of Patent: Mar. 18, 2014

(54) TONER CONTAINER

(75) Inventor: Nao Itabashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 230 days.

(21) Appl. No.: 13/238,172

(22) Filed: Sep. 21, 2011

(65) Prior Publication Data

US 2012/0087694 A1 Apr. 12, 2012

(30) Foreign Application Priority Data

Oct. 7, 2010 (JP) ..... 2010-227197

(51) Int. Cl.
*G03G 15/08* (2006.01)

(52) U.S. Cl.
USPC ..... 399/262; 399/101; 399/102; 399/103; 399/358

(58) Field of Classification Search
USPC ..... 399/101, 102, 105, 106, 258, 262
See application file for complete search history.

(56) References Cited

U.S. PATENT DOCUMENTS

| | | | | |
|---|---|---|---|---|
| 5,608,501 | A | 3/1997 | Makino | |
| 5,974,286 | A * | 10/1999 | Ban et al. | 399/106 |
| 6,289,193 | B1 * | 9/2001 | Ban et al. | 399/258 |
| 6,971,421 | B2 | 12/2005 | Takagi | |
| 7,111,654 | B2 | 9/2006 | Takagi | |
| 7,305,205 | B2 * | 12/2007 | Jeong | 399/238 |
| 8,073,357 | B2 | 12/2011 | Sakuma | |
| 2004/0123919 | A1 | 7/2004 | Takagi | |
| 2006/0000520 | A1 | 1/2006 | Takagi | |
| 2008/0267658 | A1 | 10/2008 | Takagi et al. | |
| 2009/0245854 | A1 | 10/2009 | Sakuma | |

FOREIGN PATENT DOCUMENTS

| | | |
|---|---|---|
| JP | 07-225514 | 8/1995 |
| JP | 08-292635 | 11/1996 |
| JP | 2004-139034 A | 5/2004 |
| JP | 2007-072234 A | 3/2007 |
| JP | 2008-275874 | 11/2008 |
| JP | 2009-237252 A | 10/2009 |

* cited by examiner

*Primary Examiner* — David Gray
*Assistant Examiner* — Michael Harrison
(74) *Attorney, Agent, or Firm* — Banner & Witcoff, Ltd.

(57) ABSTRACT

A toner container includes a main casing, a shutter, and a seal member. The main casing accommodates toner and is formed with a communication hole through which an interior and an exterior of the casing communicate. The shutter is selectively movable between an open position and a closed position for opening and closing the communication hole, respectively, and in either one of an opening direction and a closing direction. A shutter base portion includes edges, one positioned downstream of the other in the closing direction; and a folded portion. The seal member, configured to encircle the communication hole, is disposed between the casing and the shutter in the closed shutter position. The base portion slidingly contacts the seal member when the shutter moves between the open and closed positions. The folded portion is folded at one edge to be positioned opposite to the seal member relative to the base portion.

15 Claims, 10 Drawing Sheets

TONER CONTAINER

CROSS REFERENCE TO RELATED APPLICATION

This application claims priority from Japanese Patent Application No. 2010-227197 filed Oct. 7, 2010. The entire content of the priority application is incorporated herein by reference.

TECHNICAL FIELD

The present invention relates to a toner container that accommodates toner therein and that is detachably mountable in an image forming device such as a color printer.

BACKGROUND

A conventional image forming device has a photosensitive drum and a developing device. The developing device includes a developing unit and a toner box. The developing unit has a casing on which the toner box accommodating toner is mounted.

The toner box is formed in a shape having a circular circumferential surface, for example. The circular circumferential surface is formed with a toner discharge port for discharging toner toward an interior of the casing. The toner discharge port has a peripheral area provided with a seal member for preventing toner leakage. Further, a shutter is slidably movably provided at an outer periphery of the circular circumferential surface to open and close the toner discharge port.

After the toner box is mounted on the casing of the developing unit, the shutter is slidingly moved to open the toner discharged port. As a result, a toner supply passage is defined between the toner box and the casing through the toner discharge port. Toner is supplied to the casing from the toner box via the toner supply passage.

When an image is formed, an electrostatic latent image is formed on a surface of the photosensitive drum, and a toner image is formed on the photosensitive drum based on the electrostatic latent image. While forming the image, toner is consumed. When toner accommodated in the toner box runs out, the toner box is removed from the casing. Then, a new toner box is mounted on the casing.

Before removal of the toner box from the casing, the shutter is slidingly moved to a position confronting the toner discharge port to close the toner discharge port. In this state, the shutter is compressed by the seal member, thereby sealing any gaps formed between the shutter and the peripheral area of the toner discharge port. Therefore, while the toner box has been removed from the casing, leakage of toner remaining in the toner box from the toner discharge port can be avoided.

SUMMARY

However, when the shutter is moved to the position confronting the toner discharge port from a position where the shutter opens the toner discharge port, an edge of the shutter positioned at a downstream side with respect to the moving direction of the shutter may be caught by the seal member, and thus, a smooth movement of the shutter may be interrupted. In some cases, not only interruption of the smooth movement of the shutter but also damages to the shutter and/or the seal member may be caused.

In view of the foregoing, it is an object of the present invention to provide a toner container that ensures a smooth movement of the shutter.

In order to attain the above and other objects, the present invention provides a toner container including: a main casing; a shutter; and a seal member. The main casing defines an internal space for accommodating toner and is formed with a communication hole through which an interior and an exterior of the main casing communicate. The shutter is movable between an open position in which the communication hole is open and a closed position in which the communication hole is closed. The shutter is selectively movable in either one of an opening direction that the shutter moves to the open position from the closed position and a closing direction that the shutter moves to the closed position from the open position. The shutter includes: a base portion having a first edge and a second edge positioned downstream of the first edge in the closing direction; and a folded portion. The seal member is disposed between the main casing and the shutter when the shutter is in the closed position and configured to encircle the communication hole. The base portion is in sliding contact with the seal member when the shutter moves between the open position and the closed position. The folded portion is folded at the second edge so as to be positioned opposite to the seal member relative to the base portion.

According to another aspect, the present invention provides a developing device including: a toner container; and a developing unit provided with a developing roller. The toner container is detachably mountable in the developing unit. The toner container includes: a main casing; a first shutter; and a first seal member. The main casing defines an internal space for accommodating toner and formed with a first communication hole through which an interior and an exterior of the main casing communicate. The first shutter is movable between an open position in which the first communication hole is open and a closed position in which the first communication hole is closed. The first shutter is selectively movable in either one of an opening direction that the first shutter moves to the open position from the closed position and a closing direction that the first shutter moves to the closed position from the open position. The first shutter includes a first base portion having a first edge and a second edge positioned downstream of the first edge in the closing direction; and a first folded portion. The first seal member is disposed between the main casing and the first shutter when the first shutter is in the closed position and configured to encircle the first communication hole. The first base portion is in sliding contact with the first seal member when the first shutter moves between the open position and the closed position. The first folded portion is folded at the second edge of the first base portion so as to be positioned opposite to the first seal member relative to the first base portion. The developing unit includes: a developing frame; and a second shutter. The developing frame is formed with a second communication hole. The developing roller is rotatably supported to the developing frame. The second shutter is movable between an open position in which the second communication hole is open and a closed position in which the second communication hole is closed. The second shutter is selectively movable in either one of an opening direction that the second shutter moves to the open position from the closed position and a closing direction that the second shutter moves to the closed position from the open position.

According to still another aspect, the present invention provides a developing unit including: a developing frame; a developing roller; a shutter; and a seal member. The developing frame is formed with a communication hole. The developing roller is rotatably supported to the developing frame. The shutter is movable between an open position in which the communication hole is open and a closed position in which the communication hole is closed. The shutter is selectively movable in either one of an opening direction that the shutter moves to the open position from the closed position and in a closing direction that the shutter moves to the closed position from the open position. The shutter includes a base portion having a first edge and a second edge positioned downstream of the first edge in the closing direction, and a folded portion. The seal member is disposed between the developing frame and the shutter when the shutter is in the closed position and configured to encircle the communication hole. The base portion is in sliding contact with the seal member when the shutter moves between the open position and the closed position. The folded portion is folded at the second edge so as to be positioned opposite to the seal member relative to the base portion.

BRIEF DESCRIPTION OF THE DRAWINGS

The particular features and advantages of the present invention as well as other objects will become apparent from the following description taken in connection with the accompanying drawings, in which.

DETAILED DESCRIPTION

Next, a toner container or cartridge according to an embodiment of the present invention and an image forming device in which the toner cartridge is detachably mountable will be described while referring to FIGS. 1 to 6.

1. Color Printer

Figure 1:
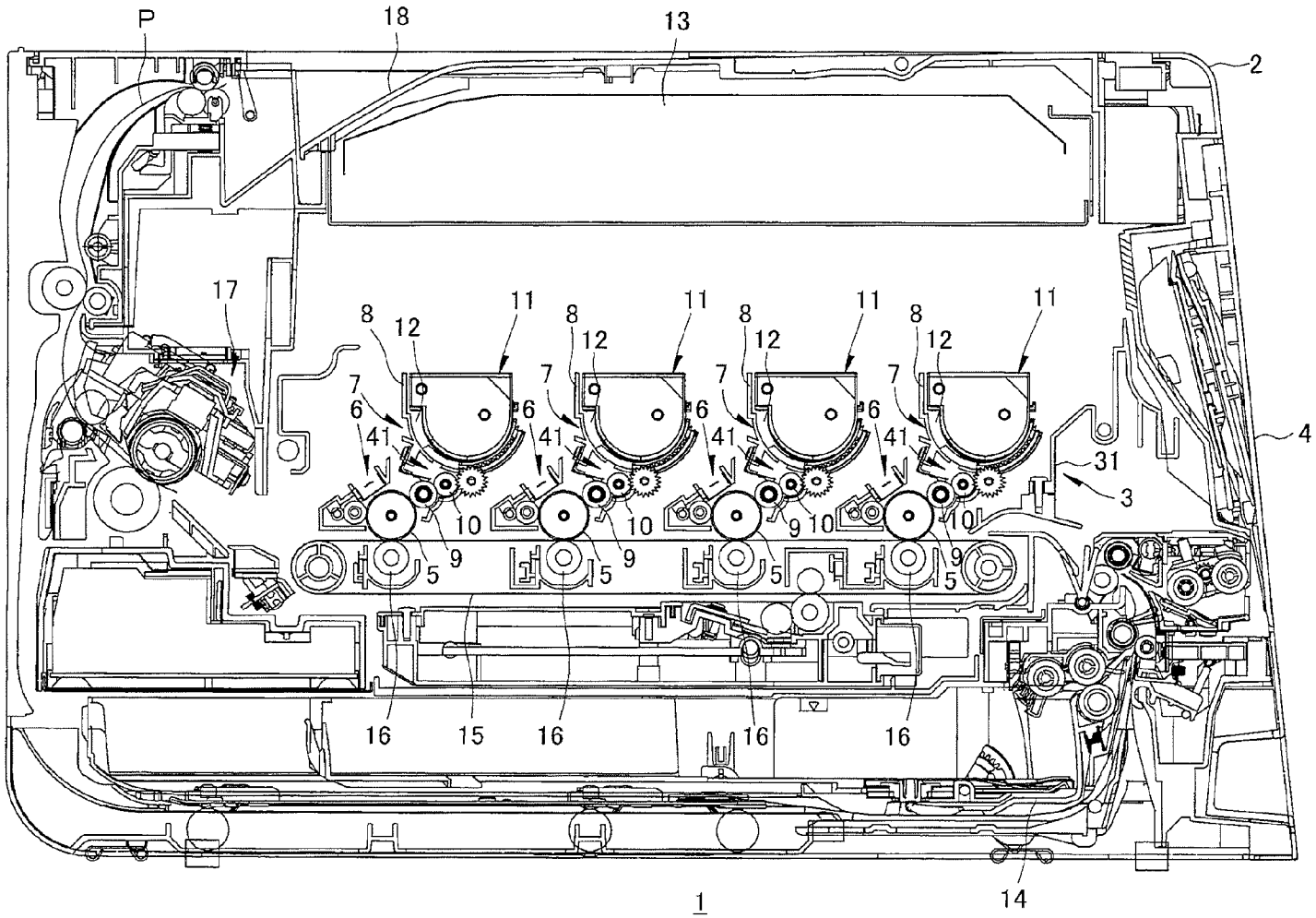
FIG. 1 is a cross-sectional view of a color printer in which a toner container or cartridge according to one embodiment of the present invention is mounted.

As shown in FIG. 1, the image forming device provided with the toner cartridge according to the embodiment is a tandem-type color printer 1. As shown in FIG. 1, the color printer 1 includes a main casing 2. A drawer unit 3 is mounted inside the main casing 2. The main casing 2 has a front portion at which a front cover 4 is provided. The front cover 4 is movable between an open position and a closed position. When the front cover 4 is in the open position, the drawer unit 3 can be moved horizontally between an accommodated position inside the main casing 2 (a position shown in FIG. 1) and a pulled-out position outside the main casing 2. When the drawer unit 3 is in the pulled-out position, the drawer unit 3 is not detached from the main casing 2, but still supported to the main casing 2, and an open space is provided above four toner cartridges 11 (described later) mounted in the drawer unit 3.

The terms "upward", "downward", "upper", "lower", "above", "below", "right", "left", "front", "rear" and the like will be used throughout the description assuming that the color printer 1 is disposed in an orientation in which it is intended to be used. In the following description, a side of the color printer 1 on which the front cover 4 is provided (right side in FIG. 1) will be referred to as a front side of the color printer 1. Top, bottom, left, and right sides of the color printer 1 in the following description will be based on the reference point of a user viewing the color printer 1 from the front side. Directions related to the drawer unit 3 and the toner cartridge 11 that is mounted in the drawer unit 3 will be referred as if the drawer unit 3 and the toner cartridge 11 had been mounted in the main casing 2, unless otherwise specified.

The drawer unit 3 includes a drawer frame 31 installing four photosensitive drums 5, four chargers 6, and four developing units 7.

As shown in FIG. 1, the four photosensitive drums 5 are rotatably retained in the drawer unit 3. The photosensitive drums 5 are rotatable about axes extending in a left-to-right direction. The four photosensitive drums 5 are respectively provided for the colors black, yellow, magenta, and cyan. The photosensitive drums 5 are arranged parallel to each other at regular intervals in a front-to-rear direction in the order black, yellow, magenta, and cyan from the front.

The four chargers 6 are also retained in the drawer unit 3. The chargers 6 have a one-on-one correspondence to the four photosensitive drums 5 and are disposed diagonally upward and rearward of the corresponding photosensitive drums 5. Each charger 6 is a Scorotron charger that includes a discharge wire and a grid, for example.

The four developing units 7 are also retained in the drawer unit 3. The four developing units 7 also have a one-on-one correspondence to the four photosensitive drums 5, and are disposed diagonally above and forward of the corresponding photosensitive drums 5.

Each developing unit 7 includes a developing unit frame 8 to which a developing roller 9 and a supply roller 10 are supported. The developing roller 9 is disposed so as to contact the corresponding photosensitive drum 5, and is rotatable about an axis extending in the left-to-right direction. The supply roller 10 is disposed diagonally above and forward of the developing roller 9 so as to contact the developing roller 9, and is rotatable about an axis extending in the left-to-right direction.

A space 12 is defined in the drawer unit 3 above each developing unit 7. The toner cartridges 11 for accommodating toner are detachably mounted in the space 12. Sufficient free space above the drawer unit 3 is acquired for mounting the toner cartridges 11 in the spaces 12 by pulling the drawer unit 3 outward to the pulled-out position. The toner cartridges 11 supply toner to the corresponding developing units 7.

An exposure unit 13 is provided in the main casing 2 above the drawer unit 3. The exposure unit 13 is adapted to irradiate four laser beams corresponding to the four colors used by the color printer 1.

As each photosensitive drum 5 rotates, the corresponding charger 6 applies a uniform charge to the surface of the photosensitive drum 5. Subsequently, the exposure unit 13 irradiates laser beams for selectively exposing the surfaces of the photosensitive drums 5. This exposure selectively removes charge from the surfaces of the photosensitive drums 5, forming electrostatic latent images thereon. When the electrostatic latent image carried on the surface of the photosensitive drum 5 rotates to a position opposite the corresponding developing roller 9, the developing roller 9 supplies toner to the electrostatic latent image, thereby forming a toner image on the surface of the photosensitive drum 5. Four LED arrays may be provided for the four photosensitive drums 5 in place of the exposure unit 13.

A sheet cassette 14 accommodating sheets of paper P is disposed at a bottom section of the main casing 2. Each sheet P accommodated in the sheet cassette 14 is conveyed onto a conveying belt 15 by various rollers. The conveying belt 15 confronts the four photosensitive drums 5 from below. Four transfer rollers 16 are disposed inside the conveying belt 15 at positions confronting the photosensitive drums 5 through an upper portion of the conveying belt 15. When the sheet P is conveyed onto the conveying belt 15, the conveying belt 15 carries the sheet P sequentially to positions between the conveying belt 15 and each of the photosensitive drums 5. As the sheet P passes beneath each photosensitive drum 5, the toner image carried on the surface of the photosensitive drum 5 is transferred onto the sheet P.

A fixing unit 17 is provided at a position downstream of the conveying belt 15 with respect to a direction that the sheet P is conveyed. After toner images are transferred onto the sheet P, the sheet P is conveyed to the fixing unit 17, where the toner images are fixed to the sheet P by heat and pressure. After the toner images have been fixed in the fixing unit 17, various rollers discharge the sheet P onto a discharge tray 18 provided on a top surface of the main casing 2.

2. Developing Unit

As shown in FIG. 1, the drawer unit 3 has the drawer frame 31. The drawer frame 31 is configured of a pair of left and right side plates arranged parallel to each other and separated in the left-to-right direction. The overall structure of the drawer frame 31 is square-shaped in a plan view. The respective groups of four photosensitive drums 5, four chargers 6, and four developing units 7 are all held together between the pair of side plates.

The four developing unit frames 8 are disposed at regular intervals in the front-to-rear direction. The developing unit frames 8 respectively define the spaces 12 provided for mounting the toner cartridges 11 thereabove.

A developing chamber 41 is provided in each developing unit frame 8 for accommodating the developing roller 9. The developing chamber 41 has a lower open side opposing the corresponding photosensitive drum 5. The developing roller 9 is disposed in the bottom of the developing chamber 41 near the open side thereof.

Figure 2:
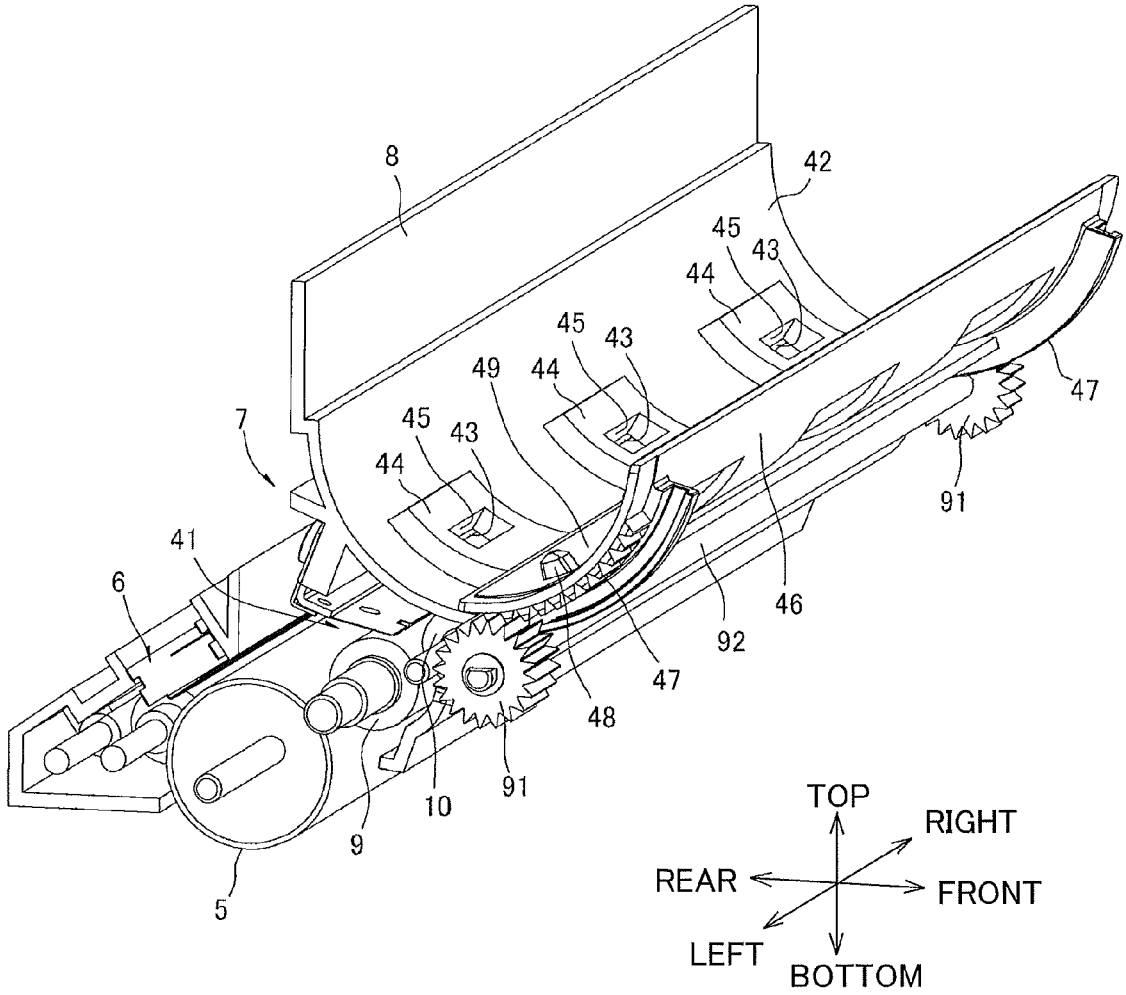
FIG. 2 is a perspective view of a photosensitive drum, a charger, and a developing unit provided in the color printer shown in FIG. 1, in which frame communication holes and seal openings are open.
Figure 3:
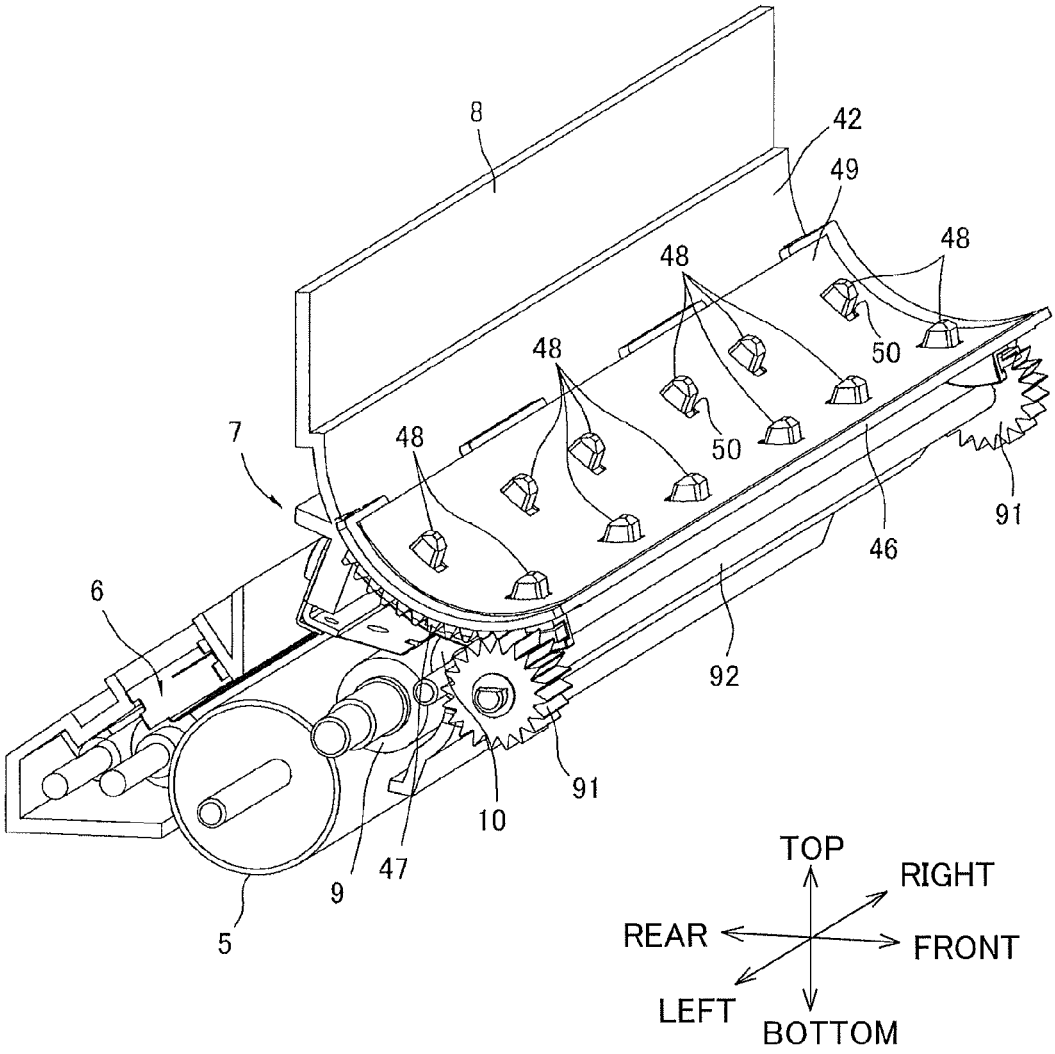
FIG. 3 is perspective view of the photosensitive drum, the charger, and the developing unit provided in the color printer shown in FIG. 1, in which the frame communication holes and the seal openings are closed by a frame shutter.

As shown in FIGS. 2 and 3, the developing unit frame 8 also has a plate-shaped partitioning wall 42 positioned between the developing chamber 41 and the space 12 for mounting the toner cartridge 11. The partitioning wall 42 curves in an arcuate shape with its convex side facing the developing chamber 41. The partitioning wall 42 partitions the interior of the developing unit frame 8 into the developing chamber 41 and the space 12 formed above the developing chamber 41.

As shown in FIG. 2, three rectangular frame communication holes 43 are formed in a circumferential center of the partitioning wall 42. The frame communication holes 43 are formed at positions opposing three cartridge communication holes 58 (FIG. 5) formed in the toner cartridge 11 when the toner cartridge 11 is mounted in the space 12. A combination of the developing unit 7 and the toner cartridge 11 will be referred to as "developing device".

As shown in FIG. 2, three frame seals 44 are disposed on the partitioning wall 42. Each of the frame seals 44 is provided for each frame communication hole 43. The frame seals 44 are affixed to the partitioning wall 42. Each frame seal 44 is formed of a foamed elastic material, and has a rectangular sheet-like form.

The frame seal 44 has a center portion formed with a seal opening 45 that provides communication with the frame communication hole 43. The seal opening 45 penetrates the frame seal 44 in a thickness direction thereof.

3. Shutter Drive Member

As shown in FIGS. 2 and 3, a shutter drive member 46 is movably disposed above the partitioning wall 42. The shutter drive member 46 is formed into an arcuate plate shaped, with the convex side facing the developing chamber 41. The arcuate shape of the shutter drive member 46 substantially conforms to the shape of the partitioning wall 42. The shutter drive member 46 is elongated in the left-to-right direction, and has left and right end portions respectively protruding from left and right edges of the partitioning wall 42. Further, each of the left and right end portions of the shutter drive member 46 respectively protruding from the left and right edges of the partitioning wall 42 has a bottom surface provided with a rack gear 47. That is, the left rack gear 47 is provided at the left end portion of the shutter drive member 46 and the right rack gear 47 is provided at the right end portion of the shutter drive member 46. The shutter drive member 46 has a top surface provided with shutter drive protrusions 48 (FIG. 3) at positions corresponding to shutter drive openings 88 (FIG. 5) described later.

4. Frame Shutter

As shown in FIGS. 2 and 3, a frame shutter 49 is provided on the shutter drive member 46. The frame shutter 49 is formed of a resin film and has a rectangular sheet-like form. The frame shutter 49 is formed with rectangular-shaped openings 50 at positions corresponding to the shutter drive protrusions 48. The frame shutter 49 is positioned relative to the shutter drive member 46 by inserting the shutter drive protrusions 48 into the openings 50, and fixed to an upper surface of the shutter drive member 46 so as to be curved to conform to the upper surface of the shutter drive member 46.

5. Toner Cartridge (1) Casing

Figure 4:
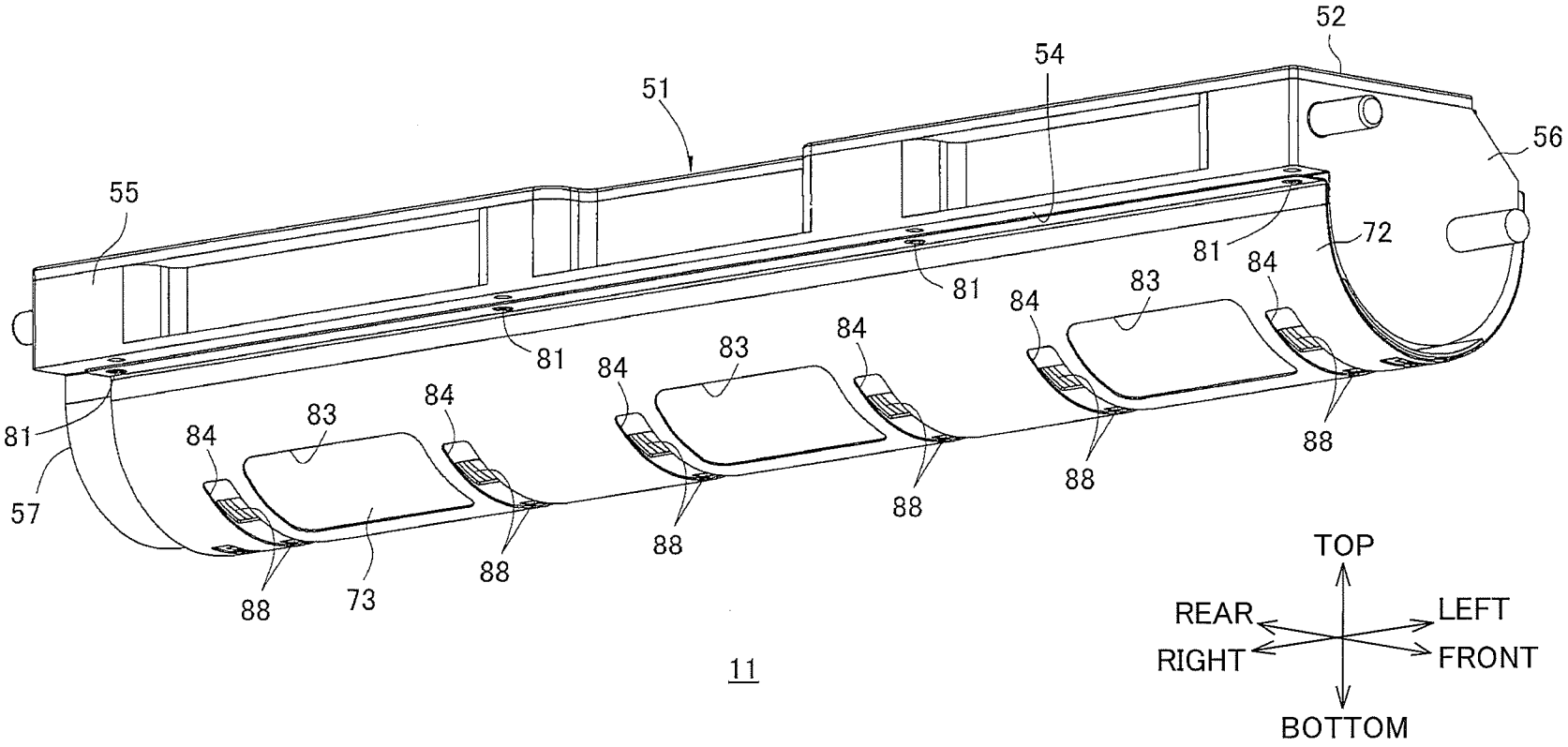
FIG. 4 is a perspective view of the toner cartridge shown in FIG. 1.
Figure 5:
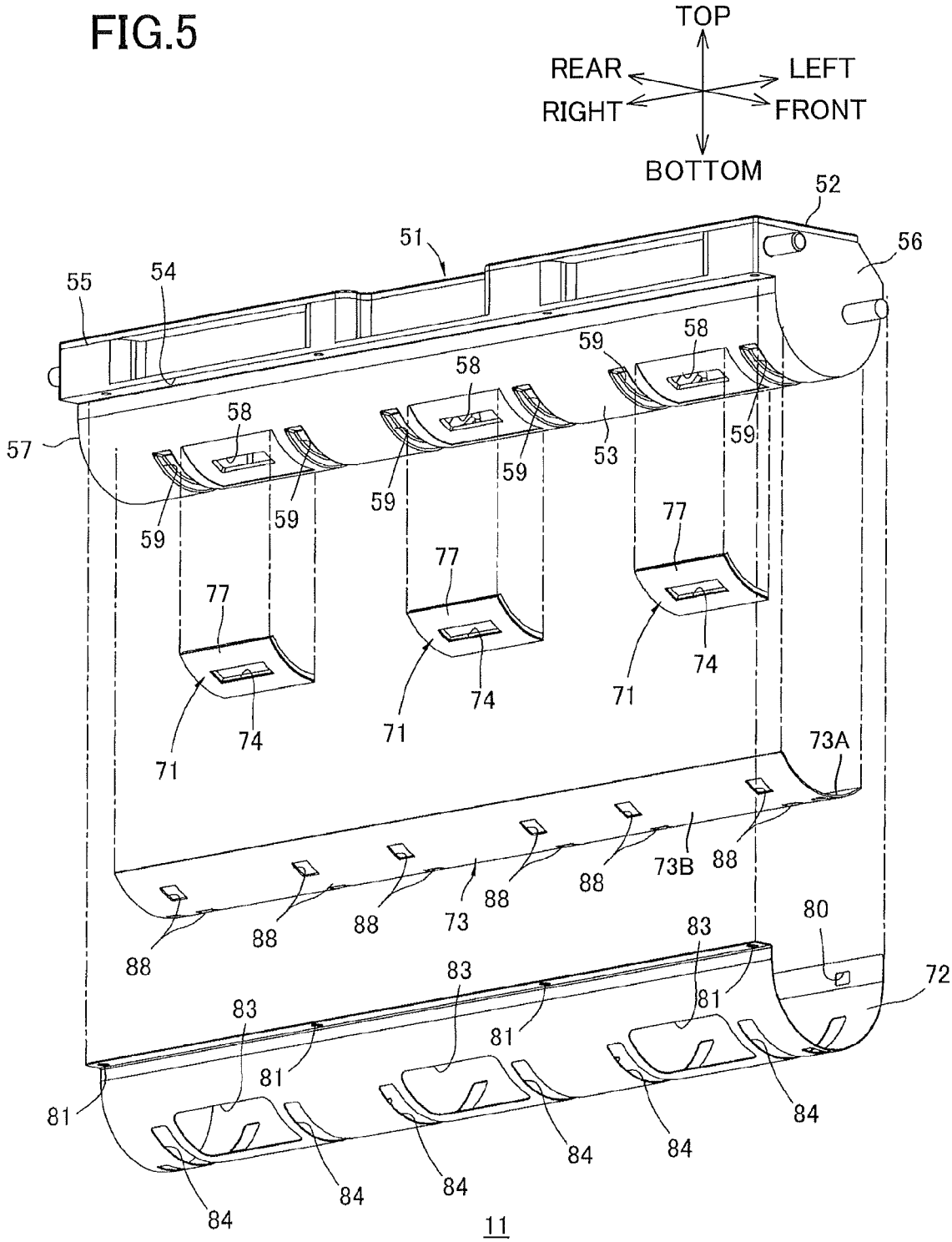
FIG. 5 is an exploded perspective view of the toner cartridge shown in FIG. 4.

As shown in FIGS. 4 and 5, the toner cartridge 11 includes a casing 51 for accommodating toner. The casing 51 is formed of resin in a substantially hollow semicircular column shape and is elongated in the left-to-right direction. More specifically, the casing 51 defines an internal space for accommodating toner, and includes a top surface 52, an arcuate surface 53, a fixing surface 54, a rear surface 55, a left side surface 56, and a right side surface 57.

The top surface 52 is formed in a rectangular shape and elongated in the left-to-right direction. The arcuate surface 53 is connected to a front edge of the top surface 52 and has a substantially semicircular shape in a cross-section with a convex side facing downward. The fixing surface 54 extends parallel to the top surface 52 and protrudes rearward from a rear edge of the arcuate surface 53. The rear surface 55 bridges a rear edge of the top surface 52 and a rear edge of the fixing surface 54. The left side surface 56 bridges respective left edges of the top surface 52, the arcuate surface 53, the fixing surface 54 and the rear surface 55. The right side surface 57 bridges respective right edges of the top surface 52, the arcuate surface 53, the fixing surface 54, and the rear surface 55.

As shown in FIG. 5, the arcuate surface 53 is formed with the three cartridge communication holes 58 at positions slightly rearward of a lowest end thereof. The cartridge communication holes 58 are rectangular in shape, elongated in the left-to-right direction, and are spaced at intervals in the left-to-right direction. The cartridge communication holes 58 provide communication between the interior and exterior of the casing 51.

Further, the arcuate surface 53 is formed with narrow slit-shaped grooves 59. The grooves 59 extend in a circumferential direction of the arcuate surface 53 and are formed one on each of left and right sides of each cartridge communication hole 58.

The arcuate surface 53 has a front edge portion on which a plurality of positioning protrusions (not shown) is formed. The positioning protrusions are spaced at intervals in the left-to-right direction. Each positioning protrusion has a hook shape, extending forward, then bending and extending upward.

The toner cartridge 11 further includes toner seals 71 affixed to the arcuate surface 53 of the casing 51, a shutter cover 72 disposed so as to cover the arcuate surface 53, and the shutter 73 disposed between the arcuate surface 53 and the shutter cover 72.

(2) Toner Seal

As shown in FIG. 5, each of the toner seals 71 is provided for each cartridge communication hole 58. The toner seal 71 has a sheet-like form and is formed of a foamed elastic material, such as the product PORON (trade name) manufactured by Rogers Inoac Corporation. The toner seal 71 is formed with a seal opening 74 at a position corresponding to the cartridge communication hole 58. The seal opening 74 has a rectangular shape and is elongated in the left-to-right direction. Each toner seal 71 is affixed to the arcuate surface 53 of the casing 51 so that the seal opening 74 is aligned and in communication with the corresponding cartridge communication hole 58 and, hence, the toner seal 71 encircle the corresponding cartridge communication hole 58. Further, the toner seal 71 has a contact surface 77 that is positioned so as to be in contact with the shutter 73.

(3) Shutter Cover

As shown in FIGS. 4 and 5, the shutter cover 72 is curved to conform to the arcuate surface 53 of the casing 51. The shutter cover 72 is formed of a thin metal plate. The shutter cover 72 has a width in the left-to-right direction slightly smaller than a width of the arcuate surface 53 in the left-to-right direction. The shutter cover 72 covers the arcuate surface 53 across substantially the entire width in the left-to-right direction, except for a right edge portion of the arcuate surface 53 having a prescribed width in the left-to-right direction.

As shown in FIG. 5, the shutter cover 72 has a front end portion formed with a plurality of positioning openings 80 spaced apart from each other in the left-to-right direction. The positioning protrusions (not shown) formed on the arcuate surface 53 of the casing 51 are engaged with the positioning openings 80. More specifically, the positioning openings 80 are formed in the front end portion of the shutter cover 72 and are arrayed in the left-to-right direction corresponding to the positioning protrusions. Further, the positioning openings 80 are formed of a sufficient size for inserting the positioning protrusions. After the positioning protrusions are inserted into the corresponding positioning openings 80, top edges of the positioning openings 80 engage the positioning protrusions.

The shutter cover 72 has a rear end portion folded back to conform to the fixing surface 54 of the casing 51. A plurality of screw insertion through-holes 81 are formed in this rear end portion of the shutter cover 72 at intervals in the left-to-right direction, as shown in FIG. 5. The shutter cover 72 is attached to the casing 51 by engaging the positioning protrusions with the respective positioning openings 80, and by inserting screws (not shown) through all of the screw insertion through-holes 81 and screwing tips of the screws into the fixing surface 54 of the casing 51.

As shown in FIG. 5, the shutter cover 72 is formed with three shutter cover openings 83 at positions corresponding to the toner seals 71. Each of the shutter cover openings 83 has a rectangular shape and is elongated in the left-to-right direction. Further, each of the shutter cover openings 83 has an open area greater than that of the seal opening 74 so as to expose the seal opening 74 in its entirety.

Further, the shutter cover 72 is formed with guide slits 84 elongated in the front-to-rear direction (circumferential direction of the shutter cover 72) at positions corresponding to the grooves 59 formed in the casing 51. Each guide slit 84 has a front-to-rear length greater than or equal to that of the groove 59. The guide slit 84 also has a left-to-right width greater than or equal to that of the groove 59. Each guide slit 84 confronts the corresponding groove 59 in its entirety.

(4) Shutter

Figure 6:
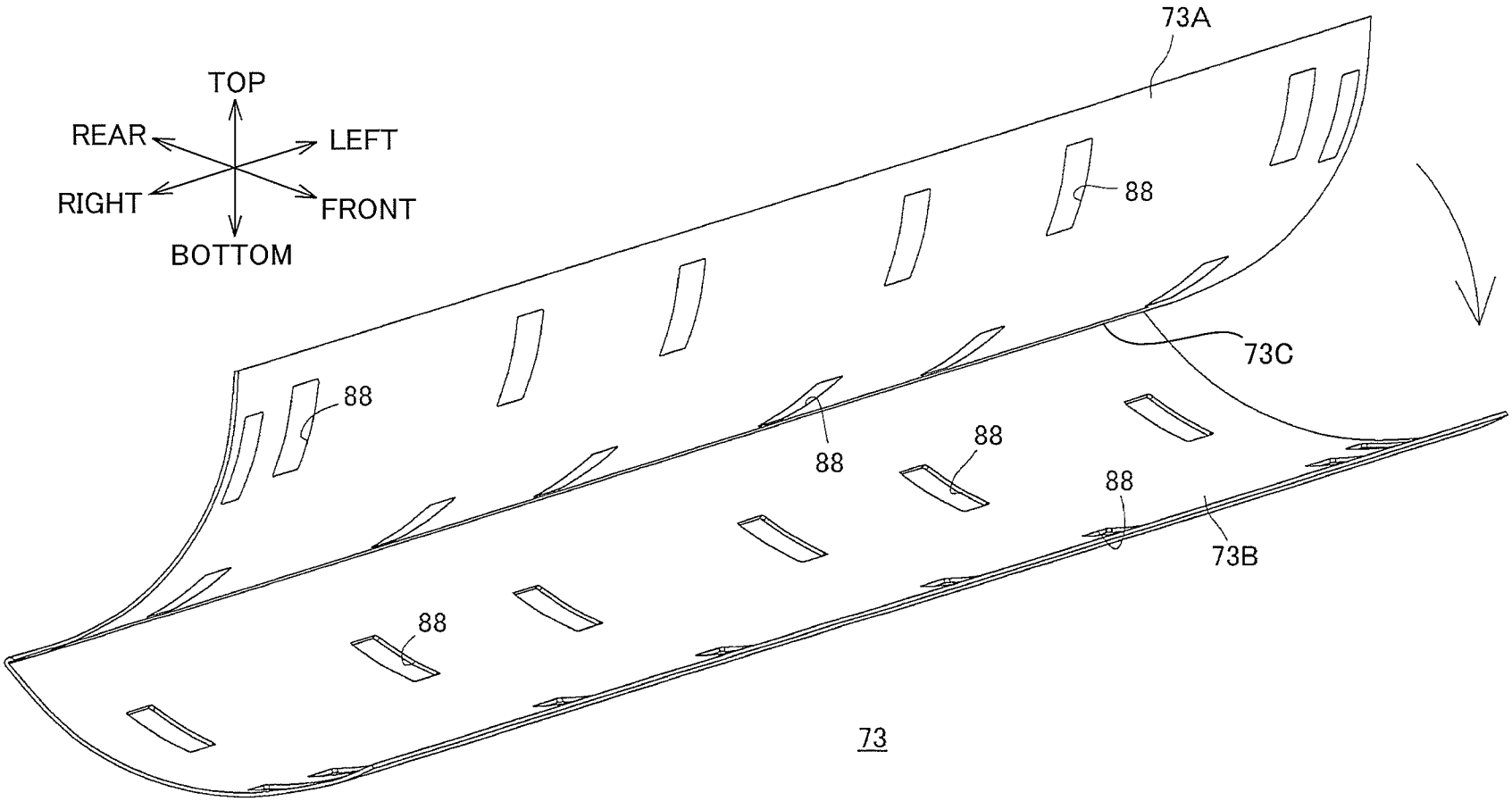
FIG. 6 is a perspective view of a shutter shown in FIG. 5, showing a process of manufacturing the shutter.

The shutter 73 is made of a resin film and curves along the arcuate surface 53 of the casing 51. More specifically, as shown in FIG. 6, the shutter 73 is formed by folding one sheet of rectangular-shaped resin film in two halves.

The shutter 73 has a base portion 73A, a folded portion 73B, and a folding line 73C. The folding line 73C defines a rear edge of the base portion 73A. In other words, the folding line 73C divides the rectangular film into the base portion 73A and the folded portion 73B. The base portion 73A has a rectangular shape and is curved to conform to the arcuate surface 53 of the casing 51. The folded portion 73B is folded below the base portion 73A at the rear edge of the base portion 73A (folding line 73C), and overlaps with the base portion 73A in its entirety. The folded portion 73B is disposed opposite to the arcuate surface 53 relative to the base portion 73A. The base portion 73A and the folded portion 73B are affixed to each other by an adhesive layer (not shown), such as an adhesive agent and an adhesive tape.

Because the folding line 73C is the rear edge of the base portion 73A, the folding line 73C also defines a rear edge of the shutter 73 that is positioned downstream of a front edge of the shutter 73 in a closing direction that the shutter 73 moves to a closed position from an open position. In other words, the folding line 73C is a leading edge of the shutter 73 when the shutter 73 is moved from its open position to its closed position.

The shutter 73 has a dimension along the circumferential direction of the arcuate surface 53 greater than that of the toner seal 71. The shutter 73 has a width in the left-to-right direction slightly smaller than that of the shutter cover 72. The shutter 73 also has a width in the left-to-right direction greater than respective widths of the cartridge communication hole 58, the toner seal 71, and the shutter cover opening 83.

The shutter 73 is formed with two shutter drive openings 88 separated by a prescribed interval in a circumferential direction of the shutter 73 at positions opposing each groove 59 in the casing 51. The shutter drive openings 88 penetrate the shutter 73, that is, penetrates both the base portion 73A and the folded portion 73B. The distance between the two shutter drive openings 88 in the circumferential direction is set such that all shutter drive openings 88 confront the corresponding grooves 59 and confront and communicate with the corresponding guide slits 84 formed in the shutter cover 72, regardless of whether the shutter 73 is in the open position or in the closed position described later.

The shutter 73 is interposed between the arcuate surface 53 of the casing 51 and the shutter cover 72. While held between the arcuate surface 53 and the shutter cover 72, the shutter 73 can move between the open position and the closed position.

When the shutter 73 is in the open position, the rear edge of the shutter 73 is interposed between a front edge portion of the toner seal 71 and the shutter cover 72. Therefore, each cartridge communication hole 58 formed in the casing 51 and the seal opening 74 formed in the corresponding toner seal 71 are made open, while being in communication between the cartridge communication holes 58 and the shutter cover openings 83. This provides communication between the interior and exterior of the casing 51.

On the other hand, in the closed position, the shutter 73 is positioned farther rearward than the open position. When the shutter 73 is in the closed position, the rear edge of the shutter 73 is positioned slightly rearward from rear edges of the shutter cover openings 83. As a result, the shutter 73 covers the cartridge communication holes 58 formed in the casing 51 and the seal openings 74 formed in the toner seals 71 in their entirety, blocking communication between the interior and exterior of the casing 51. At this time, the toner seals 71 are interposed between the shutter 73 and the arcuate surface 53 of the casing 51.

6. Drive Force Transmission Mechanism

Within the drawer frame 31, a plurality of drive force transmission mechanisms each corresponding to each shutter drive member 46 is provided. Each drive force transmission mechanism functions to transmit a drive force to the corresponding shutter drive member 46. As shown in FIGS. 2 and 3, each drive force transmission mechanism includes a pair of pinion gears 91 and a connecting shaft 92. One of the pinion gears 91 is engageable with the left rack gear 47, and remaining one of the pinion gears 91 is engageable with the right rack gear 47. The connecting shaft 92 provides connection and concurrent rotation between the pair of pinion gears 91.

The connecting shaft 92 extends in the left-to-right direction, and has left and right end portions that are rotatably supported to the drawer frame 31. Although not shown, the left end portion of the connecting shaft 92 penetrates the left side plate of the drawer frame 31, and protrudes leftward from the left side plate. An operation lever (not shown) is fixed to the left end portion of the connecting shaft 92 protruding from the left side plate of the drawer frame 31.

When the operation lever is operated, the pair of pinion gears 91 rotate to transmit a rotational force to the rack gears 47. As a result, the shutter drive member 46 moves in the front-to-rear direction along the partitioning wall 42, and, the shutter 73 moves between the open position and the closed position in association with the movement of the shutter drive member 46.

7. Opening and Closing Shutter

When the toner cartridge 11 has been removed from the drawer unit 3, the shutter 73 is in the closed position. Further, as shown in FIG. 3, the shutter drive member 46 and the frame shutter 49 are positioned so as to confront the frame communication holes 43 formed in the partitioning wall 42, so that the frame communication holes 43 are closed by the frame shutter 49 provided on the shutter drive member 46.

While the drawer unit 3 (drawer frame 31) is pulled outward from the main casing 2 and disposed at the pulled-out position (FIG. 1), the toner cartridge 11 can be mounted in or dismounted from the space 12 from above. When the toner cartridge 11 is mounted in the space 12, each of the shutter drive protrusions 48 is brought into engagement with the corresponding shutter drive openings 88 formed in the shutter 73 through the corresponding guide slits 84 formed in the shutter cover 72.

After the toner cartridge 11 has been mounted in the space 12, the operation lever (not shown) is operated to move the shutter 73 to the open position from the closed position. This operation allows the pinion gears 91 to rotate in a clockwise direction as viewed from a left side. A rotational force of the pinion gears 91 is transmitted to the rack gears 47 of the shutter drive member 46. As a result, the shutter drive member 46 moves forward to a position not confronting the frame communication holes 43 formed in the partitioning wall 42 from a position confronting the frame communication holes 43. In association with the forward movement of the shutter drive member 46, the shutter 73 moves forward to the open position from the closed position (i.e. moves in an "opening direction") together with the shutter drive member 46 and the frame shutter 49, while the base portion 73A is in sliding contact with the contact surfaces 77 of the toner seals 71. When the shutter drive member 46 further moves forward to a position where the rack gears 47 are disengaged from the pinion gears 91, the shutter 73 is positioned at the open position. At this time, a rear edge of the frame shutter 49 is disposed in front of a front edge of each seal openings 45 formed in the frame seal 44 and behind a front edge of each frame seals 44, as shown in FIG. 2.

Each toner seal 71 is therefore brought into pressure contact with the corresponding frame seal 44. Each seal opening 45 formed in the frame seal 44 confronts the corresponding seal opening 74 formed in the toner seal 71, thereby providing communication between the interior of the developing chamber 41 of the developing unit 7 and the interior of the casing 51 of the toner cartridge 11 via the frame communication holes 43, the seal opening 45, the seal opening 74, and the cartridge communication holes 58. As a result, fluid communication of toner between the interior of the developing chamber 41 and the interior of the casing 51 can be achieved.

When the shutter 73 is moved to the closed position from the open position, the operation lever is operated in an opposite manner when the shutter 73 is moved to the open position from the closed position. With this operation, the pinion gears 91 are rotated in a counterclockwise direction as viewed from the left side. A rotational force of the pinion gears 91 is transmitted to the rack gears 47. As a result, the shutter drive member 46 moves rearward. In association with the rearward movement of the shutter drive member 46, the shutter 73 moves rearward to the closed position from the open position (i.e. moves in a "closing direction") together with the shutter drive member 46 and the frame shutter 49, while the base portion 73A is in sliding contact with the contact surfaces 77 of the toner seals 71.

When the shutter drive member 46 further moves rearward to a position where the rack gears 47 are disengaged from the pinion gears 91, the shutter 73 is positioned at the closed position. At this time, as shown in FIG. 3, the shutter drive member 46 and the frame shutter 49 are disposed at positions confronting the frame communication holes 43 formed in the partitioning wall 42. Hence, the frame communication holes 43 are closed by the frame shutter 49 provided on the shutter drive member 46.

8. Operations and Effects (1) Operation and Effect 1

As described above, the toner cartridge 11 includes the casing 51 defining an internal space for accommodating toner. The casing 51 is formed with the three cartridge communication holes 58 for providing communications between the interior and exterior of the casing 51. In order to close or open these cartridge communication holes 58, the shutter 73 is provided in the casing 51. To this effect, the shutter 73 is movable between the open position in which the cartridge communication holes 58 are open and the closed position in which the cartridge communication holes 58 are closed. When the shutter 73 is in the closed position, the toner seals 71 are interposed between the casing 51 and the shutter 73.

The shutter 73 has the base portion 73A and the folded portion 73B. The base portion 73A is in sliding contact with the toner seals 71 during movement of the shutter 73 between the open position and the closed position. The folded portion 73B is folded below the base portion 73A at the downstream edge of the base portion 73A (shutter 73) in the closing direction to be disposed opposite to the toner seals 71 relative to the base portion 73A. The folding line 73C is defined between the base portion 73A and the folded portion 73B, constituting the downstream edge of the base portion 73A (shutter 73) in the closing direction, that is, the rear edge of the shutter 73. Therefore, the rear edge of the shutter 73 has no burr formed by cutting, for example, during a manufacturing process of the shutter 73. Because of the absence of burrs, the downstream edge of the shutter 73 in the closing direction is not caught by the toner seal 71 when the shutter 73 moves in the closing direction. Therefore, a smooth movement of the shutter 73 in the closing direction can be ensured, and damage to the shutter 73 and the toner seals 71 can be prevented.

(2) Operation and Effect 2

The toner cartridge 11 includes the shutter cover 72. The shutter cover 72 is provided in the toner cartridge 11 so that the shutter 73 is interposed between the shutter cover 72 and the casing 51. The shutter cover 72 is formed with the three shutter cover openings 83 at positions confronting the cartridge communication holes 58. With this configuration, the shutter cover 72 can protect the shutter 73 without blocking communication of toner between the cartridge communication holes 58 and the shutter cover openings 83.

(3) Operation and Effect 3

The folded portion 73B has a dimension in the closing direction (i.e. along the circumferential direction of the arcuate surface 53) equal to that of the base portion 73A. This configuration can prevent a front edge of the folded portion 73B from being caught by the circumferential edges of the shutter cover openings 83 formed in the shutter cover 72.

(4) Operation and Effect 4

The folded portion 73B is positioned in direct confrontation with the shutter cover openings 83 when the shutter 73 is in the closed position. Further, the folded portion 73B has a width in a widthwise direction (i.e. the left-to-right direction) perpendicular to the closing direction greater than that of the shutter cover opening 83. Hence, the front edge of the folded portion 73B can be reliably prevented from being caught by the circumferential edges of the shutter cover openings 83.

(5) Operation and Effect 5

The base portion 73A and the folded portion 73B are adhered to each other by the adhesive layer. The adhesive layer prevents the folded portion 73B from separating (being peeled) from the base portion 73A. As a result, the front edge of the folded portion 73B can be further prevented from being caught by the circumferential edges of the shutter cover openings 83.

(6) Operation and Effect 6

When moving to the closed position from the open position, the shutter 73 moves through toner deposited around the cartridge communication holes 58. If the shutter 73 has a great thickness, toner may be deposited on the rear edge of the shutter 73 (i.e. downstream edge in the closing direction) while the shutter 73 moves through toner. There may be a risk of toner spilling out of the toner cartridge 11.

However, the shutter 73 is made of a resin film, and therefore, has a small thickness. Accordingly, when moving to the closed position from the open position, deposition of toner on the rear edge of the shutter 73 can be prevented. As a result, toner leakage from the toner cartridge 11 can also be prevented. Further, because the shutter 73 is formed of a film, the shutter 73 can establish a close contact with the toner seals 71.

9. Modifications

Various modifications are conceivable.

(1) First Modification

Figure 7:
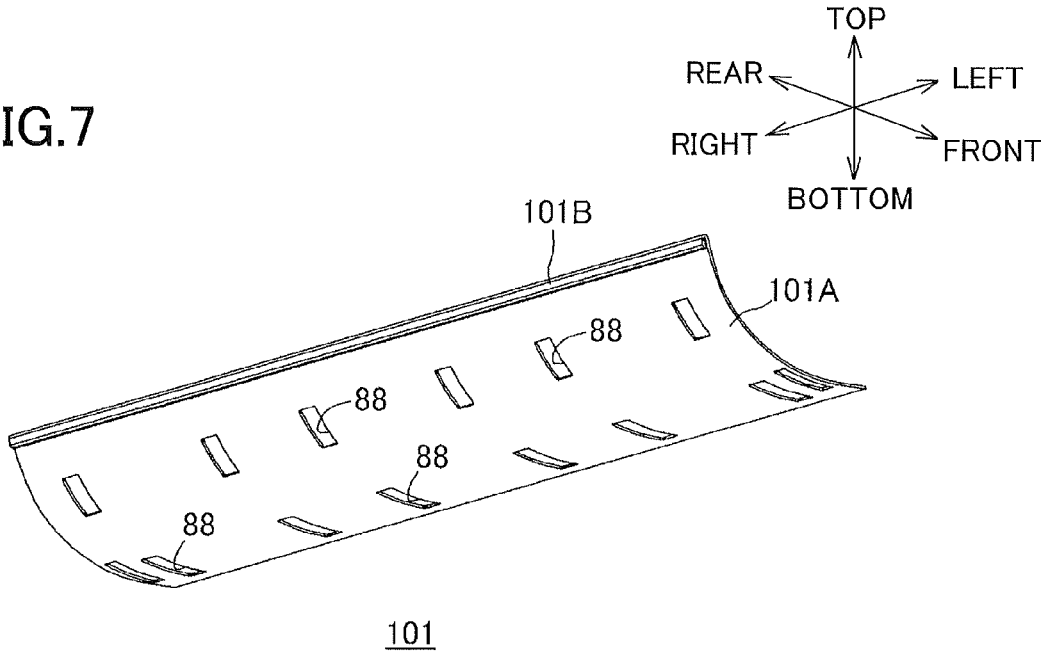
FIG. 7 is a perspective view of a shutter according to a first modification that can be used as substitute for the shutter shown in FIG. 6.

Instead of the shutter 73 shown in FIG. 6, a shutter 101 shown in FIG. 7 is available. In the following description, only parts of the shutter 101 differing from those of the shutter 73 will be described. In FIG. 7, like parts and components are designated by the same reference numerals of those shown in FIG. 6 to avoid duplicating description.

Figure 8:
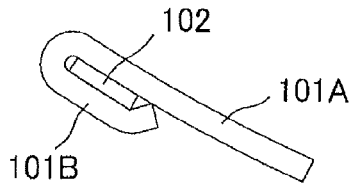
FIG. 8 is an enlarged left side view of a rear end portion of the shutter shown in FIG. 7.

The shutter 101 is formed of a resin film. The shutter 101 has a base portion 101A and a folded portion 101B. The base portion 101A has a rectangular shape and is curved to conform to the arcuate surface 53 (FIG. 5) of the casing 51. The folded portion 101B is folded below the base portion 101A at a rear edge of the base portion 101A. The folded portion 101B overlaps only with a rear end portion of the base portion 101A in its entire width in the left-to-right direction. The folded portion 101B is disposed opposite to the arcuate surface 53 relative to the base portion 101A. Further, as shown in FIG. 8, the rear end portion of the base portion 101A and the folded portion 101B are adhered to each other by an adhesive layer 102, such as an adhesive agent and an adhesive tape. Incidentally, the shutter drive openings 88 are formed in the base portion 101A only.

In the above embodiment, the folding line 73C defines the rear edge of the shutter 73 (i.e. downstream edge in the closing direction). Likewise, a folding line defined between the base portion 101A and the folded portion 101B constitutes a rear edge of the shutter 101 (i.e. downstream edge in the closing direction). Therefore, there is no burr formed in the downstream edge of the shutter 101 in the closing direction. Thus, a smooth movement of the shutter 101 in the closing direction can be ensured, and damage to the shutter 101 and the toner seals 71 can be prevented.

(2) Second Modification

Figure 9:
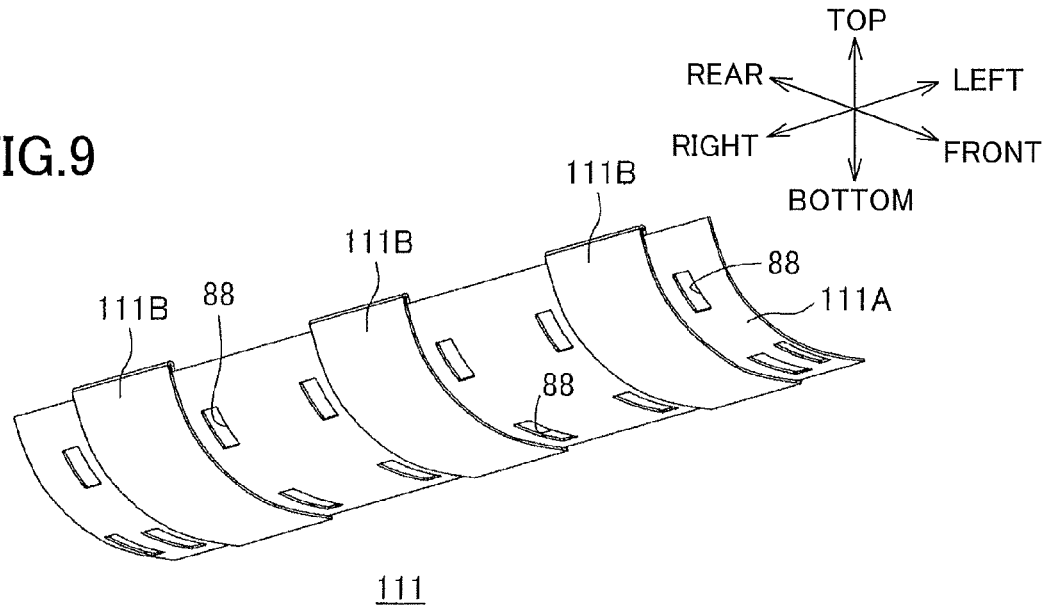
FIG. 9 is a perspective view of a shutter according to a second modification that can be used as substitute for the shutter shown in FIG. 6.
Figure 10:
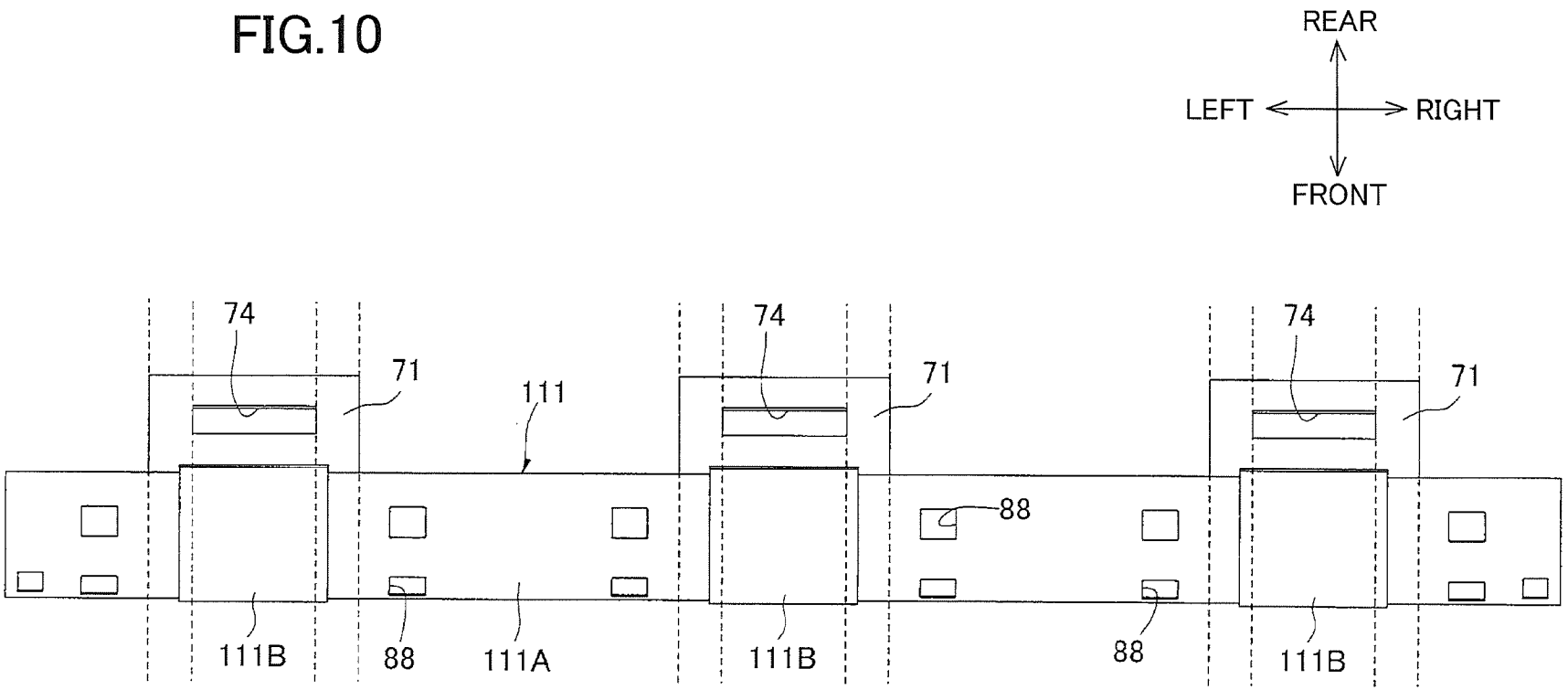
FIG. 10 is a bottom view of the shutter shown in FIG. 9 and a toner seal.

Instead of the shutter 73 shown in FIG. 6, a shutter 111 shown in FIGS. 9 and 10 is also available. In the following description, only parts of the shutter 111 differing from those of the shutter 73 will be described. In FIGS. 9 and 10, like parts and components are designated by the same reference numerals of those shown in FIG. 6 to avoid duplicating description.

The shutter 111 is formed of a resin film. The shutter 111 has a base portion 111A and a plurality of folded portions 111B. The base portion 111A has a rectangular shape and is curved to conform to the arcuate surface 53 (FIG. 5) of the casing 51. Each folded portion 111B is folded below the base portion 111A at a rear edge of the base portion 111A. Each of the folded portions 111B overlaps with a portion of the base portion 111A. The folded portions 111B are disposed opposite to the arcuate surface 53 relative to the base portion 111A. Further, the base portion 111A and the plurality of folded portions 111B are adhered to each other by an adhesive layer (not shown), such as an adhesive agent and an adhesive tape.

As shown in FIG. 10, the plurality of folded portions 111B is disposed so as to confront the cartridge communication holes 58 formed in the arcuate surface 53 and the seal openings 74 formed the toner seals 71, interposing the base portion 111A between the folded portions 111B and the seal openings 74 of the toner seals 71, when the shutter 111 is moved to the closed position. As shown in FIG. 9, each folded portion 111E has a dimension in the closing direction (i.e. along the circumferential direction of the arcuate surface 53) equal to that of the base portion 111A. As shown in FIG. 10, each folded portion 111B has a width in the left-to-right direction greater than that of the cartridge communication hole 58 or the seal opening 74.

The shutter 111 has portions that pass over the seal openings 74 when the shutter 111 moves in the closing direction or in the opening direction. A folding line defined between the base portion 111A and each folded portion 111B constitutes a rear edge of the portion. Therefore, there is no burr formed in the rear edge of each portion. Thus, the rear edges of the portions of the shutter 111 can be prevented from being caught by the circumferential edges (especially, rear edges) of the seal openings 74 when the shutter 111 moves in the closing direction. As a result, a smooth movement of the shutter 111 in the closing direction can be ensured, and damage to the shutter 111 and the toner seals 71 can be prevented.

Figure 11:
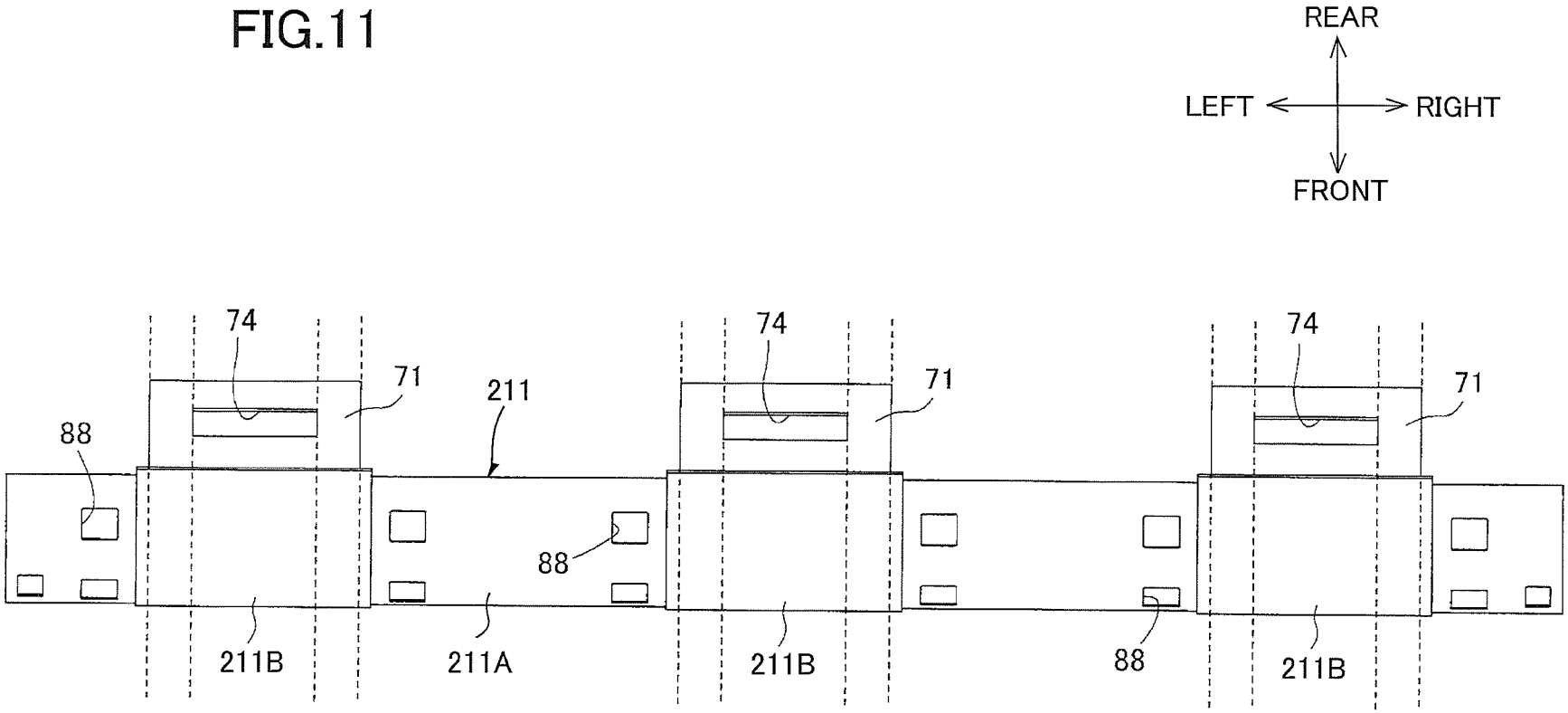
FIG. 11 shows a further modification to the shutter shown in FIG. 9.

FIG. 11 shows a modification to the second modification. According to this modification, a shutter 211 formed of a resin film has a base portion 211A and a plurality of folded portions 211B. Further, the base portion 211A and the plurality of folded portions 211B are adhered to each other by an adhesive layer (not shown), such as an adhesive agent and an adhesive tape. As shown in FIG. 11, each folded portion 211B has a dimension in the closing direction (i.e. along the circumferential direction of the arcuate surface 53) equal to that of the base portion 211A, and a width in the left-to-right direction greater than that of the toner seal 71. In this case, the rear edge of the shutter 211 can be prevented from being caught by the seal opening 74 when the shutter 211 moves in the closed direction.

(3) Third Modification

Figure 12:
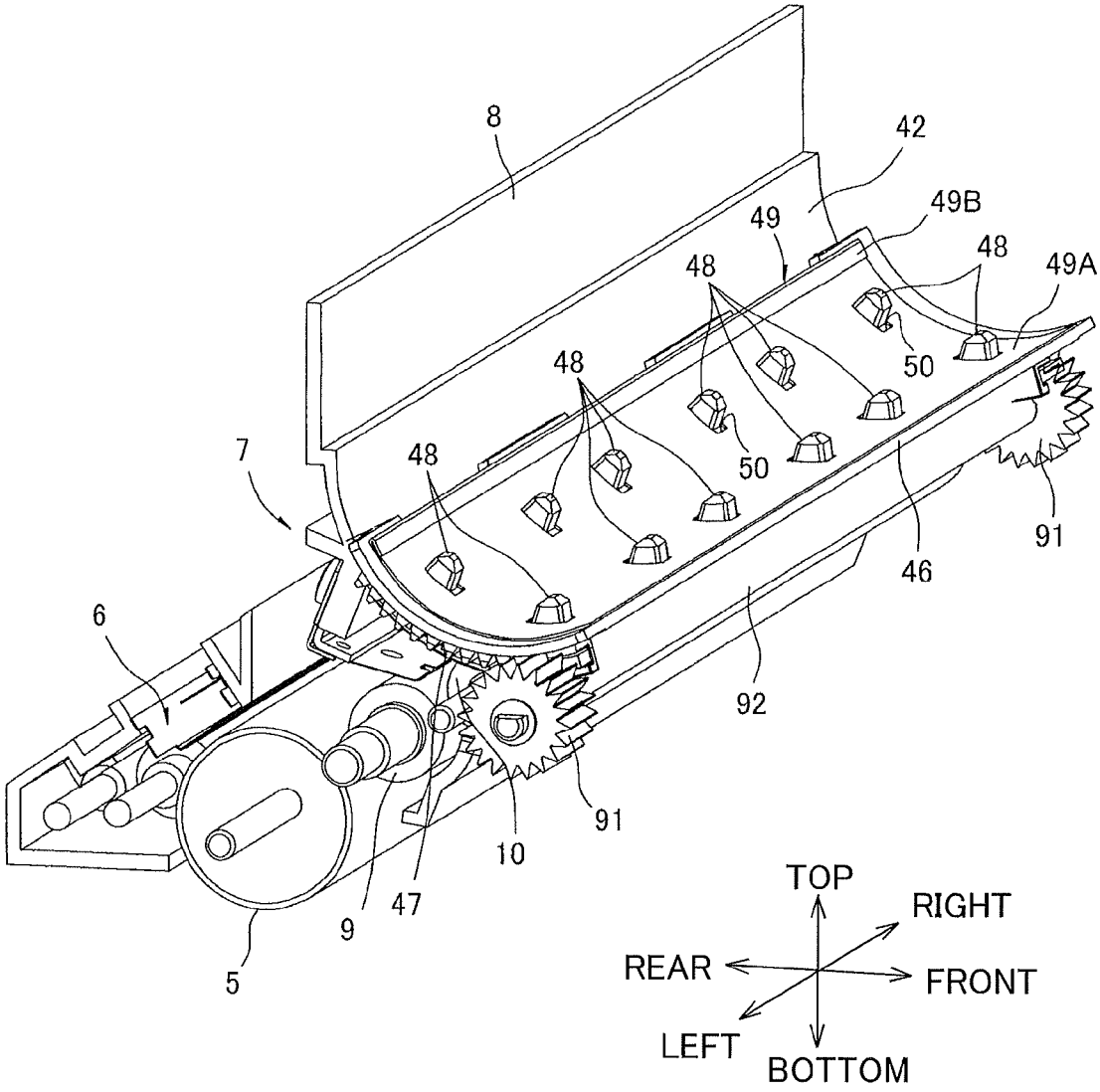
FIG. 12 is a perspective view of the photosensitive drum, the charger, and the developing unit provided in the color printer shown in FIG. 1, in which the shutter according to the first modification shown in FIG. 7 is applied to a frame of the developing unit.

In the above-described embodiment, the toner cartridge 11 serves as a toner container. However, the structures of the shutter 73, the shutter 101, the shutter 111, or the shutter 211 can be applied to the frame shutter 49. For example, FIG. 12 shows that the shutter 101 is applied to the frame shutter 49. That is, the frame shutter 49 has a base portion 49A and a folded portion 49B. The folded portion 49B is folded above the base portion 49A at a rear edge of the base portion 49A. The folded portion 49B is positioned opposite to the partitioning wall 42 relative to the base portion 49A.

While the invention has been described in detail with reference to the embodiment thereof, it would be apparent to those skilled in the art that various changes and modifications may be made therein without departing from the scope of the invention.

What is claimed is:

1. A toner container comprising:

a main casing defining an internal space for accommodating toner and formed with a communication hole through which an interior and an exterior of the main casing communicate;

a shutter movable between an open position in which the communication hole is open and a closed position in which the communication hole is closed, the shutter being selectively movable in either one of an opening direction such that the shutter moves to the open position from the closed position and a closing direction such that the shutter moves to the closed position from the open position, the shutter comprising:

a base portion having a first edge and a second edge positioned downstream of the first edge in the closing direction; and a folded portion; and a seal member disposed between the main casing and the shutter when the shutter is in the closed position and configured to enclose the communication hole, the base portion being configured to be in sliding contact with the seal member when the shutter moves between the open position and the closed position, the folded portion being folded at a fold along the second edge so as to be positioned opposite to the seal member relative to the base portion, the seal member being formed with a seal opening at a position corresponding to the communication hole, the fold being configured to move across the seal opening when the shutter moves from the open position to the closed position and when the shutter moves from the closed position to the open position.

2. The toner container as claimed in claim 1, wherein the folded portion is disposed so as to overlap with the communication hole with interposing the base portion between the communication hole and the folded portion when the shutter moves between the open position and the closed position, the folded portion having a width in a widthwise direction perpendicular to the closing direction greater than that of the communication hole.

3. The toner container as claimed in claim 2, wherein the folded portion is disposed so as to overlap with the seal member with interposing the base portion between the seal member and the folded portion when the shutter moves between the open position and the closed position, the folded portion having a width in the widthwise direction greater than that of the seal member.

4. The toner container as claimed in claim 1, wherein the folded portion is folded at an entire portion of the second edge so as to be positioned opposite to the seal member relative to the base portion.

5. The toner container as claimed in claim 1, wherein the folded portion has a dimension in the closing direction equal to that of the base portion.

6. The toner container as claimed in claim 1, further comprising an adhesive layer that fixes the folded portion to the base portion.

7. The toner container as claimed in claim 1, further comprising a shutter cover configured to interpose the shutter with the main casing, the shutter cover being formed with an opening at a position confronting the communication hole.

8. The toner container as claimed in claim 7, wherein the folded portion is disposed so as to overlap with the opening when the shutter moves between the open position and the closed position, the folded portion has a width in a widthwise direction perpendicular to the closing direction greater than that of the opening.

9. The toner container as claimed in claim 1, wherein the shutter is formed of a film.

10. The toner container as claimed in claim 1, the toner container being detachably mountable in a developing unit provided with a developing roller.

11. A developing device comprising:

a toner container comprising:

a main casing defining an internal space for accommodating toner and formed with a first communication hole through which an interior and an exterior of the main casing communicate;

a first shutter movable between an open position in which the first communication hole is open and a closed position in which the first communication hole is closed, the first shutter being selectively movable in either one of an opening direction such that the first shutter moves to the open position from the closed position and a closing direction such that the first shutter moves to the closed position from the open position, the first shutter comprising:

a first base portion having a first edge and a second edge positioned downstream of the first edge in the closing direction; and a first folded portion; and a first seal member disposed between the main casing and the first shutter when the first shutter is in the closed position and configured to encircle the first communication hole, the first base portion being in sliding contact with the first seal member when the first shutter moves between the open position and the closed position, the first folded portion being folded at the second edge of the first base portion so as to be positioned opposite to the first seal member relative to the first base portion; and a developing unit provided with a developing roller, the toner container being detachably mountable in the developing unit, the developing unit comprising:

a developing frame formed with a second communication hole, the developing roller being rotatably supported to the developing frame; and a second shutter movable between an open position in which the second communication hole is open and a closed position in which the second communication hole is closed, the second shutter being selectively movable in either one of an opening direction such that the second shutter moves to the open position from the closed position and a closing direction such that the second shutter moves to the closed position from the open position.

12. The developing device as claimed in claim 11, wherein the second shutter comprises a second base portion having a first edge and a second edge positioned downstream of the first edge in the closing direction, and a second folded portion; and the developing unit further comprising a second seal member disposed between the developing frame and the second shutter when the second shutter is in the closed position and configured to encircle the second communication hole, the second base portion being in sliding contact with the second seal member when the second shutter moves between the open position and the closed position, the second folded portion being folded at the second edge of the second base portion so as to be positioned opposite to the second seal member relative to the second base portion.

13. The developing device as claimed in claim 11, wherein the second shutter has a shape the same as that of the first shutter.

14. The developing device as claimed in claim 11, wherein the second shutter is formed of a film.

15. A developing unit comprising:

a developing frame formed with a communication hole;

a developing roller rotatably supported to the developing frame;

a shutter movable between an open position in which the communication hole is open and a closed position in which the communication hole is closed, the shutter being selectively movable in either one of an opening direction that the shutter moves to the open position from the closed position and in a closing direction that the shutter moves to the closed position from the open position, the shutter comprising a base portion having a first edge and a second edge positioned downstream of the first edge in the closing direction, and a folded portion; and a seal member disposed between the developing frame and the shutter when the shutter is in the closed position and configured to enclose the communication hole, the base portion being configured to be in sliding contact with the seal member when the shutter moves between the open position and the closed position, the folded portion being folded at a fold along the second edge so as to be positioned opposite to the seal member relative to the base portion, the seal member being formed with a seal opening at a position corresponding to the communication hole, the fold being configured to move across the seal opening when the shutter moves from the open position to the closed position and when the shutter moves from the closed position to the open position.

* * * * *